United States Patent [19]

Winter, IV

[11] Patent Number: 4,833,855

[45] Date of Patent: May 30, 1989

[54] PREFABRICATED PANEL HAVING A JOINT THEREON

[76] Inventor: Amos G. Winter, IV, Pinnacle Springs Rd., Spofford, N.H. 03462

[21] Appl. No.: 178,858

[22] Filed: Apr. 7, 1988

Related U.S. Application Data

[63] Continuation-in-part of Ser. No. 41,934, Apr. 27, 1987, abandoned.

[51] Int. Cl.[4] ..... E04C 1/10

[52] U.S. Cl. ..... 52/592; 52/612; 52/593

[58] Field of Search ..... 52/591, 594, 592, 593, 52/309.9, 309.11, 309.14, 612, 80

[56] References Cited

U.S. PATENT DOCUMENTS

| | | | |
|---|---|---|---|
| 1,995,264 | 3/1935 | Mason | 52/592 |
| 3,000,114 | 9/1961 | Kitson | 52/309.11 |
| 3,138,898 | 6/1964 | Charter | 52/595 |
| 3,186,130 | 6/1965 | Gray | 52/595 |
| 3,331,173 | 7/1967 | Elsner | 52/309.11 |
| 3,462,897 | 8/1969 | Weinrott | 52/309.11 |
| 3,667,180 | 6/1972 | Tischak | 52/309.9 |
| 3,712,004 | 1/1973 | Loebsack | 52/309.11 |
| 3,791,082 | 2/1974 | Bowling | 52/593 |
| 4,242,390 | 12/1980 | Nemeth | 52/594 |
| 4,425,065 | 1/1984 | Sweeney | 411/23 |
| 4,519,866 | 5/1985 | Stol | 156/250 |
| 4,614,071 | 9/1986 | Sams | 52/592 |

FOREIGN PATENT DOCUMENTS

| | | | |
|---|---|---|---|
| 762542 | 7/1971 | Belgium | 52/309.9 |
| 18328 | 10/1980 | European Pat. Off. | 52/612 |
| 2247752 | 4/1973 | Fed. Rep. of Germany | 52/309.9 |
| 2444132 | 8/1980 | France | 52/612 |
| 1170444 | 11/1969 | United Kingdom | 52/592 |
| SE85/264 | 1/1987 | World Int. Prop. O. | 52/309.11 |

*Primary Examiner*—Henry E. Raduazo
*Attorney, Agent, or Firm*—George W. Dishong

[57] ABSTRACT

A unique prefabricated panel having joints on at least the vertical edges of the panel is provided which can be easily and effectively assembled into a wall by gluing the panels together at the edges without the need for splines or stud posts thereby creating a joint, preferably a captured scarf joint, which is strong and which joint provides for a large bonding surface and is effective to capture, align and rigidly secure the panels together and importantly maintain the skin strength through the joint. When a joint, preferably a captured scarf joint, is provided on the horizontal edges and the vertical edges, larger panels can be assembled from smaller panels while maintaining the skin strength of the larger panel. The panels can be also be effectively assembled as a floor or a roof. There is no buckling of the shingles of the roof when the panels of the instant invention are used.

9 Claims, 3 Drawing Sheets

PREFABRICATED PANEL HAVING A JOINT THEREON

This application is a continuation-in-part, of application Ser. No. 041,934, filed Apr. 27, 1987, now abandoned.

BACKGROUND OF THE INVENTION

1. FIELD OF THE INVENTION

This invention relates to the field of prefabricated wall, roof and floor panels and more particularly to providing panels which may be fabricated, in a novel way from smaller panel pieces, so as to continue the skin strength (both compression and tensile) and which panels have incorporated novel means for more securely, efficiently and economically joining such panels to form either structural/load bearing walls or non-structural/-non-loading bearing walls which may be highly insulative with substantially no thermal bridges.

2. DESCRIPTION OF THE PRIOR ART

The rising cost of labor and materials have made building construction and especially the construction of homes increasingly more expensive. In addition the cost of heating and cooling a building has increased many times over in recent years. In order to keep the costs of construction, heat, cooling and maintenance within reasonable limits and therefore affordable to the general public, innovations have been necessary. In part because of the availability of prefabricated structure-wall and curtain-wall panels of the type discussed herein, there has been a return to the post and beam type of modular construction which lends itself to a prefabrication of the many construction components away from the construction site. By prefabricating and precutting many of the components of the structure at a manufacturing facility, many procedures may be used to improve the fabrication efficiency and improve the quality of the components as well as reduce the construction time.

Prefabricated panels that may or may not be load bearing are provided at the construction site and are designed to be used with the post and beam construction. The panels which do not carry a load are sometimes referred to as curtain wall panels and can be used to rapidly enclosed the post and beam frame. The exterior or outer skin of the panel is provided ready for siding to be applied and the inside or inner skin of the panel is provided ready for application of any desired interior finish. Currently the panels, whether they are structure-wall panels (load bearing) or curtain-wall panels (non-load bearing), are connected one to the other along the vertical edges of the panels by what is referred to as splines or stud posts. These splines or stud posts unfortunately introduce thermal bridges. Further, the joint of adjacent wall so joined by the stud posts, whether by mechanical or by gluing means, do not continue the strength of the panel skins. In U.S. Pat. No. 4,578,909 smaller than normal load bearing panels are shown assembled without the use of stud posts. Such an assembly requires that the panels have either the foam insulation extend beyond the panel skins or the panel skins extend beyond the foam insulative core. The two types of panel edges can then be alternatively abutted and fastened, by glueing for example, to form a wall. It should be clearly noted that the assembled wall does not provide for a panel or wall skin which has continuous strength from panel to panel.

It would be advantageous to provide a prefabricated insulative panel all of which are the same as far as the design of the core and skin configuration and none of which would require the use of an additional component such as a spline or stud post to attach panels to form a larger panel or wall. In addition to the stud posts being an additional component, they also reduce the effective insulative property of the completed building because they create thermal bridges. thus the elimination of the stud post or splines improves the thermal efficiency of the completed building in addition to enhancing the construction efficiency and reducing the cost.

Simply abutting the edges of the present prior art panels against stud posts by inserting the stud post in a slot in the panel or abutting panel edge to panel edge by inserting the extended foam core of one panel into a slot in the adjacent panel, in addition to the above shortcomings, does not provide for a very strong joint. It would therefore be desireable to provide a joining system which would be strong, would accurately align adjacent panels, would maintain thermal integrity, would minimize material waste (door and window cut-outs could be reassembled into full sized panels), reduce construction labor costs and which is simple and low in cost and would allow a continuous, homogeneous panel to be made from smaller panel pieces.

SUMMARY OF THE INVENTION

It is important to note that, when the panels are assembled to form a wall or a roof assembly, the strength of the skins are continued from panel to panel without the need for stud posts or the like when the surfaces of the joints are tightly joined using a fastening means, such as for example glue, the tensile and compression forces are continued through the joint region from panel skin to panel skin and the wall has the character of a single continuous surface.

The present invention is directed to a prefabricated panel, sometimes referred to as a stress skin panel, having an inner skin or an outer skin or both which are securely affixed to a core material. The panel has two vertical and two horizontal edges which define the panel dimensionally. At least the two vertical edges having configured thereon a male portion of a joint such as for example a captured scarf joint, a tongue and groove joint or a mortise and tenon joint on one of the vertical edges and a female portion of a joint on the other of the vertical edges which may or may not correspond to the type of joint on the one vertical edge.

It is a primary object of the present invention to provide prefabricated panels having a joining system such that the panels can be simply, securely and economically assembled to form larger panels which have skin strength which is continuous over the entire skin surface of the assembled panel.

It is another object of the invention to provide panels which have a joining system such that when the panels are assembled to form structure-walls, curtain-walls (non-load bearing walls) roof panels or floor panels, there will be substantially no thermal bridges resulting from such assembly of the panels and the insulation or core thickness is uniform and continuous throughout the wall.

A further object of the present invention is to provide a prefabricated panel having a joining system such that the edges have increased and sufficient surface area so that a proper adhesive such as for example a microencapsulated adhesive applied to an edge or to a plurality of edges will, upon joining the panels, result in a joint through which the strength of the panel skin will be continued.

It is a still further object of the invention to provide a panel which when assembled with other such panels results in a substantially smooth and continuous inner and outerwall surface which can be easily finished subsequent to the assembly of the wall.

These and further objects of the present invention will become apparant to those skilled in the art after a study of the present disclosure of the invention.

DESCRIPTION OF THE PREFERRED EMBODIMENTS

The following is a description of the preferred embodiment of the invention. It is understood that joints other than a captured scarf joint would be effective to join smaller panels to make larger panels and which other joints would provide the desired continuation of the skin strength in both structure-wall and curtain-wall panels assembled from such panels.

That is to say that the tension (or tensile) and the compression forces which exist when the panels are assembled to form a wall or a larger structure from a plurality of panels, are transmitted through the joints so that the wall behaves as a single unit. One cannot tell after a wall is assembled using the panels disclosed herein where the joints are located because of the skin strength continuity that results when the panels are tightly joined, using for example glue as a fastening means. There is what appears to be a homogeneous distribution of the tension and compression forces thoughout the structure made up of the tightly joined panels. The captured scarf joint will be the joint used to describe, in detail, the present invention. additionally more emphasis will be placed upon the assembly of wall from panels as compared to the assembly of larger panels from small panels or from "scrap pieces" of panels. It is also understood that floors can be assembled from the prefabricated panels of this invention in a manner similar to the assembly of walls as described herein.

Figure 1:
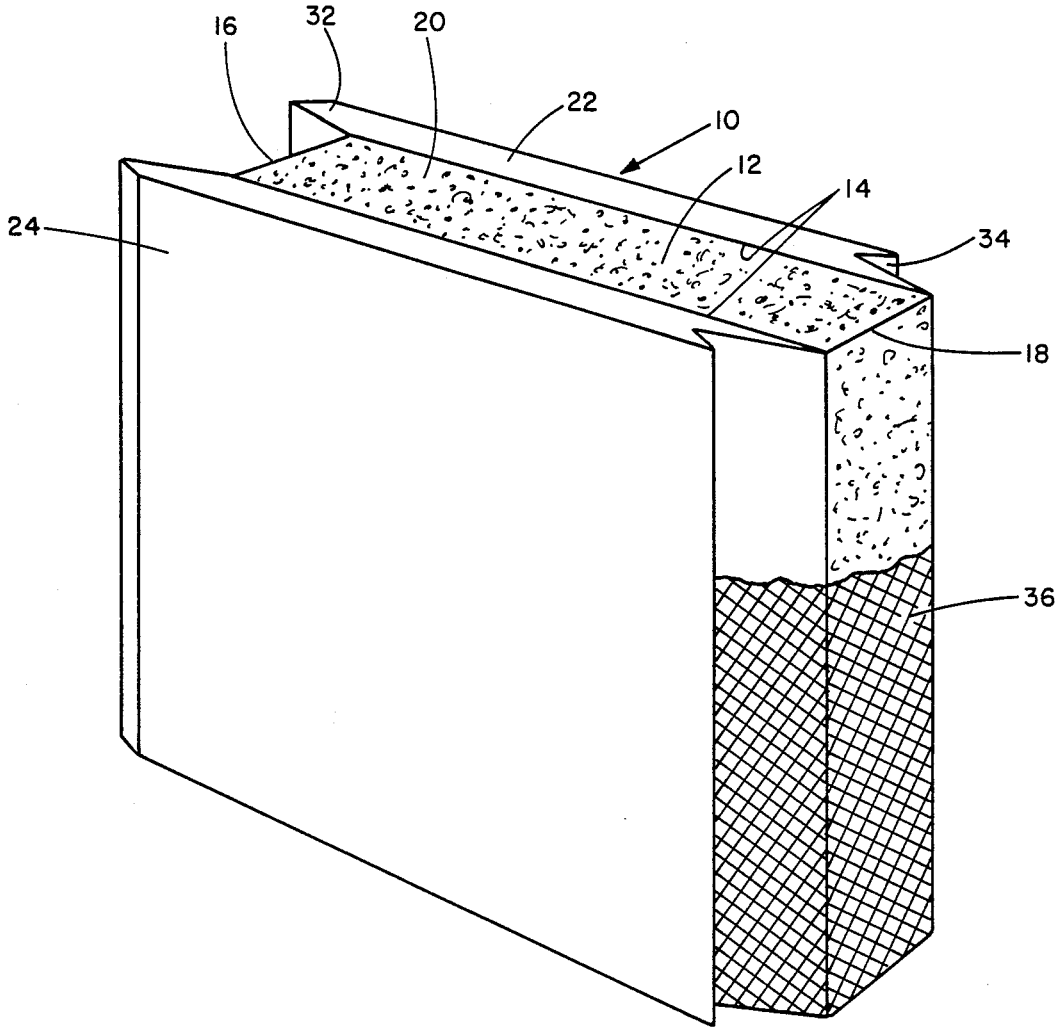
FIG. 1 is a perspective view of the prefabricated panel according to the present invention.
Figure 2:
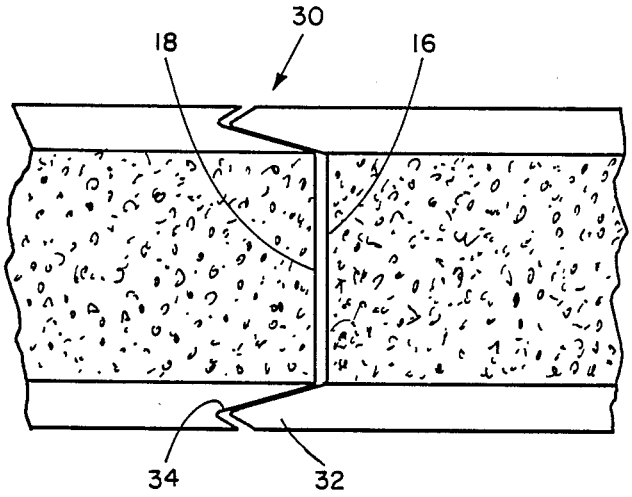
FIG. 2 is a top view of the captured scarf joint illustrating the joining of two panels.

Referring now to the preferred embodiment shown in FIGS. 1 and 2 which illustrates a prefabricated panel 10 showing the captured scarf joint 30 used to join two panels together to form a wall. the panel 10 has an insulative core 12 which core 12 has substantially flat opposed surfaces 14. It is of course understood that the core may be material other than an insulative material such as for example a paper honeycomb or any other material which could function as a core for the panels. On one of the flat surfaces 14 is an outer skin 24 which is material such as plywood, wafer board, particle board or oriented strand board or material over which siding may be attached. The other flat surface 14 has an inner skin 22 which may be gypsum board, plywood or other material may be used for the interior wall covering or as the base for the finished interior wall. The panel is initially fabricated having a generally rectangular configuration with vertical edges 16 and 18 and two horizontal edges 20. The edges 20, 16 and 18 defining the size of the panel 10. The skins 22 and 24 are typically attached to the core 12 when the core 12 is fabricated. After the panel 10 is fabricated the male portion 32 and the female portion 34 of the captured scarf joint is machined, or molded or cut into the vertical edges 16 and 18 of the panel 10. In the preferred embodiment and in particular where in-the-field assembly is to be used a micro - encapsulated adhesive 36 is applied to either or both of the portions 32 and 34 of the captured scarf joint 30.

That is to say that the inner and the outer skins of joined panels being tight and continuous is meant to convey the notion that the skin strength from panel to panel appears or behaves as a continuous skin without joints would appear from a structural and a strength standpoint.

Upon assembling panels 10 in order to form walls, it has been found that the captured scarf joint 30 permits the effective assembly of panels 10 using only the adhesive 36. When the panels 10 are assembled the adhesive is caused to become activated upon pressure being applied to the captured scarf joint 30 and upon the adhesive 36 which has been applied to one or both of the portions 32 or 34 of the joint 30 thus eliminating the need for splines or stud posts. It has been observed that because of the special angles and unique characteristics of the captured scarf joint 30, the panels 10 being joined are captured, very easily aligned and securely held in position. In addition to the larger bonding area provided by the captured scarf joint 30 the joint 30 is not tight until it is completely closed thereby causing a very tight and continuous inner skin 22 and outer skin 24.

Figure 3:
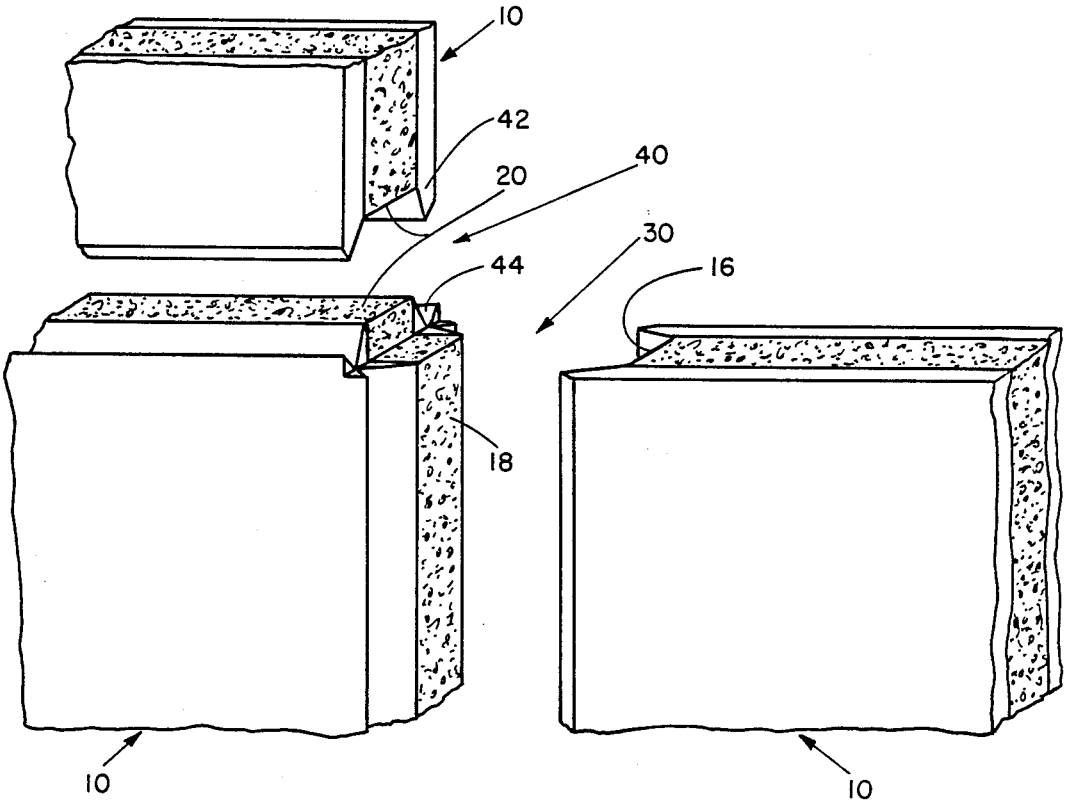
FIG. 3 is a view of the panel illustrating the male and female portions of the captured scarf joint on the horizontal edges of the panel.
Figure 4:
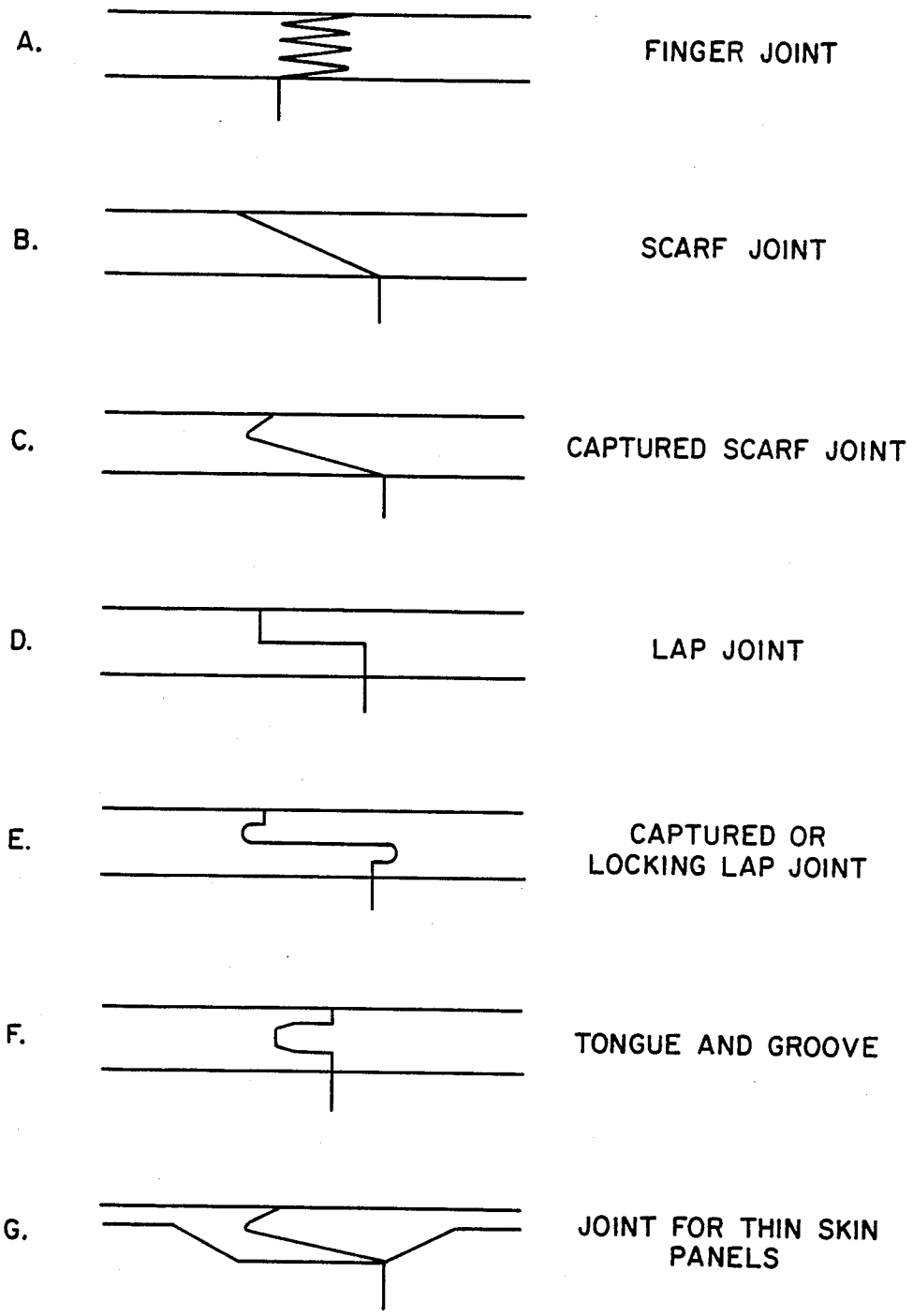
FIGS. 4A-G are illustrations of various types of joints which will continue the panel strength through the joint itself.

When panels 10 of the instant invention are used, for example, to fabricate a roof diaphram a captured scarf joint 40 having a male portion 42 and a female portion 44 as illustrated in FIG. 3 may be machined onto the horizontal edges 20 of panels 10 thereby permitting the joining of panels 10 not only along the vertical edges 16 and 18 but also along the horizontal edges 20. The manufacturers of the most commonly used roof covering or sheathing recommend leaving a substantial space between pieces. As the sheathing swells or contracts, the roof shingles wrinkle or buckle. The fabricated roof diaphram using the panels 10 solves the problems of wrinkling of roof shingles on waferboard roof deck because it eliminated the movement toward the joints 30 and 40. By glueing the panels 10 of the instant invention the entire roof assembly behaves as a single diaphram absorbing and/or distributing the stresses of expansion. Additionally it should also be noted that the roof deck is fastened to the roof frame without the need to nail or screw through the entire panel thickness which thereby does not result in thermal bridges.

It is thought that the prefabricated panel of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A prefabricated panel of a character such that when a plurality of said panels are assembled, using a fastening means, in tight mating edge to mating edge relationship, tensile and compression forces are transmitted between adjacent panel skins comprising:

a substantially homogeneous core of insulative material said core having two substantially flat opposed surfaces, two opposed and substantially vertical core edges, and two opposed and substantially horizontal core edges defining thereby the size of said wall panel;

a skin having a predetermined thickness and sized substantially the same as and securely affixed to one of said flat surfaces, said skin material being different from said core material and said skin having two opposed and substantially vertical skin edges, and two opposed and substantially horizontal skin edges said skin is material selected from waferboard, oriented strand board, fiberboard, plaster board, sheetrock, wood panel, wire, wire reinforced paper, pressboard, particle board, plywood, metal and plastic; and a joint selected from the group consisting of, captured scarf joint, finger joint, mortise and tenon joint, locking lap joint and tongue and groove joint, configured onto at least said two vertical skin edges, a male portion of said joint configured onto one of said vertical skin edges and a female portion of said joint configured onto the other of said vertical skin edges whereby upon tightly joining a plurality of said prefabricated panels, using a means for joining, the tensile and compression forces are transmitted between adjacent panel skins.

2. A prefabricated panel of a character such that when a plurality of said panels are assembled, using a fastening means, in tight mating edge to mating edge relationship, tensile and compression forces are transmitted between adjacent panel skins comprising:

a substantially homogeneous core of insulative material said core having two substantially flat opposed surfaces, two opposed and substantially vertical edges, and two opposed and substantially horizontal edges defining thereby the size of said wall panel;

an inner skin having a predetermined thickness and sized substantially the same as and securely affixed to one of said flat surfaces said inner skin having two opposed and substantially vertical inner skin edges, and two opposed and substantially horizontal inner skin edges;

an outer skin having a predetermined thickness and sized substantially the same as and securely affixed to the other of said flat surfaces said outer skin having two opposed and substantially vertical outer skin edges, and two opposed and substantially horizontal outer skin edges;

at least one of said skins is material different from said core material and selected from waferboard, oriented strand board, fiberboard, plaster board, sheetrock, wood panel, wire, wire reinforced paper, pressboard, particle board, plywood, metal and plastic; and a joint selected from the group consisting of, captured scarf joint, finger joint, mortise and tenon joint, locking lap joint and tongue and groove joint, configured onto at least said two vertical inner and outer skin edges, a male portion of said joint configured onto one of said vertical inner and outer skin edges and a female portion of said joint configured onto the other of said vertical inner and outer skin edges whereby upon tightly joining a plurality of said prefabricated panels, using a means for joining, the tensile and compression forces are transmitted between adjacent panel skins.

3. The prefabricated panel according to claim 2 further comprising a micro-encapsulated adhesive applied onto at least one of the surfaces of said male and female portions of said joint.

4. The prefabricated panel according to claim 2 wherein both said inner skin and said outer skin is material selected from waferboard, oriented strand board, fiberboard, plaster board, sheetrock, wood panel, wire, wire reinforced paper, pressboard, particle board, plywood, metal, and plastic.

5. The prefabricated panel according to claim 4 wherein one of said at least two opposed and substantially vertical core edges extends beyond corners formed by the outwardly facing surface of said inner and said outer skins, and the other of said vertical core edge is recessed inward of said other of said vertical skin edge by an amount substantially equal to the amount by which said one core edge extends.

6. A prefabricated panel of a character such that when a plurality of said panels are assembled, using a fastening means, in tight mating edge to mating edge relationship, tensile and compression forces are transmitted between adjacent panel skins comprising:

a substantially homogeneous core of insulative material said core having two substantially flat opposed surfaces, two opposed and substantially vertical core edges, and two opposed and substantially horizontal core edges defining thereby the size of said wall panel, an inner skin having a predetermined thickness and sized substantially the same as and securely affixed to one of said flat surfaces said inner skin having two opposed and substantially vertical inner skin edges, and two opposed and substantially horizontal inner skin edges, an outer skin having a predetermined thickness and sized substantially the same as and securely affixed to the other of said flat surfaces said outer skin having two opposed and substantially vertical inner skin edges, and two opposed and substantially horizontal inner skin edges;

at least one of said skins is material different from said core material and selected from waferboard, oriented strand board, fiberboard, plaster board, sheetrock, wood panel, wire, wire reinforced paper, pressboard, particle board, plywood, metal and plastic;

a first joint selected from the group consisting of, captured scarf joint, finger joint, mortise and tenon joint, locking lap joint and tongue and groove joint, configured onto said two vertical inner and outer skin edges, a male portion of said first joint configured onto one of said vertical inner and outer skin edges and a female portion of said first joint configured onto the other of said vertical inner and outer skin edges; and a second joint selected from the group consisting of, captured scarf joint, finger joint, mortise and tenon joint, locking lap joint and tongue and groove joint, configured onto said two horizontal inner and outer skin edges, a male portion of said joint configured onto one of said horizontal inner and outer skin edge and a female portion of said second joint configured onto the other of said horizontal inner and outer skin edge whereby upon tightly joining a plurality of said prefabricated panels, using a means for joining, the tensile and compression forces are transmitted between adjacent panel skins.

7. The prefabricated panel according to claim 6 further comprising a micro-encapsulated adhesive applied onto at least one of the surfaces of said male and female portions of said joint.

8. The prefabricated panel according to claim 6 wherein both said inner skin and said outer skin is material selected from waferboard, oriented strand board, fiberboard, plaster board, sheetrock, wood panel, wire, wire reinforced paper, pressboard, particle board, plywood, metal and plastic.

9. The prefabricated panel according to claim 8 wherein one of said at least two opposed and substantially vertical core edges extends beyond corners formed by the outwardly facing surface of said inner and said outer skins, and the other of said vertical core edge is recessed inward of said other of said inner and outer vertical skin edge by an amount substantially equal to the amount by which said one vertical core edge extends and wherein one of said two opposed and substantially horizontal core edges extends beyond corners formed by the outwardly facing surface of said inner and said outer skins, and the other of said horizontal core edge is recessed inward of said other inner and outer vertical skin edge by an amount substantially equal to the amount by which said one horizontal core edge extends.

* * * * *